United States Patent [19]

Tanaka et al.

[11] 4,393,819

[45] Jul. 19, 1983

[54] SYSTEM FOR CONTROLLING COOLING WATER TEMPERATURE FOR WATER-COOLED ENGINE

[75] Inventors: Takayuki Tanaka, Komae; Rempei Matsumoto, Ohta, both of Japan

[73] Assignee: Fuji Jukogyo Kabushiki Kaisha, Tokyo, Japan

[21] Appl. No.: 371,761

[22] Filed: Apr. 26, 1982

[30] Foreign Application Priority Data

Apr. 30, 1981 [JP] Japan ..... 55-65672

[51] Int. Cl.[3] ..... F01P 7/14

[52] U.S. Cl. ..... 123/41.08; 123/41.44; 236/34.5

[58] Field of Search ..... 237/12.3 B; 236/34, 236/34.5; 165/40; 123/41.02, 41.08, 41.44

[56] References Cited

U.S. PATENT DOCUMENTS

| | | | |
|---|---|---|---|
| 1,500,418 | 7/1924 | Page et al. | 123/41.08 |
| 2,134,662 | 10/1938 | Flamm | 123/41.08 |
| 3,851,629 | 12/1974 | Mayr et al. | 236/34.5 X |
| 3,921,600 | 11/1975 | Henning et al. | 236/34.5 X |
| 3,939,807 | 2/1976 | Eichinger | 123/41.08 |
| 4,337,733 | 7/1982 | Hirata et al. | 123/41.1 |

*Primary Examiner*—William E. Tapolcai
*Attorney, Agent, or Firm*—Martin A. Farber

[57] ABSTRACT

A system for controlling cooling water temperature for an engine has a radiator, a cooling water passage communicating a water jacket in the engine with the radiator, and a thermostat provided in the cooling water passage. The system is provided with a bypass for bypassing the thermostat, a bypass valve provided in the bypass for closing the bypass; and a solenoid operated valve for actuating the bypass valve. Switch circuits are connected parallel to the solenoid operated valve means. The switch circuits comprises a low temperature switch responsive to low cooling water temperature to effect the operation of the solenoid operated valve for closing the bypass valve of the bypass, a high temperature switch responsive to high cooling water temperature to effect the operation of the solenoid operated valve for closing the bypass valve, a light load switch responsive to the light load operation of the engine to effect the operation of said solenoid operation valve for closing the bypass valve, and a heater switch connected to the high temperature switch in series, whereby the cooling water temperature is controlled according to the engine operation and the heater operation.

4 Claims, 3 Drawing Figures

SYSTEM FOR CONTROLLING COOLING WATER TEMPERATURE FOR WATER-COOLED ENGINE

BACKGROUND OF THE INVENTION

The present invention relates to a system for controlling cooling water temperature for an engine mounted on a vehicle and more particularly to a system which controls the temperature of the cooling water to a proper temperature according to load on the engine and operation of a heater for a room of the vehicle.

Japanese patent publication No. 54-9665 discloses a cooling water control system which is provided with two thermostats for low temperature control and high temperature control. The system has disadvantages that the two thermostats occupy a large space and that the cooling water temperature is unsufficiently controlled for the heater which causes decrease of heating efficiency in heavy load condition. Generally, the heater system of the vehicle uses the cooling water. Accordingly, it is necessary to control the cooling water temperature for heating effect.

SUMMARY OF THE INVENTION

The object of the present invention is to provide a cooling water controlling system which controls the temperature of the cooling water according to the load on the engine and operation of the heater. In the system of the present invention, the cooling water flow to a radiator is regulated by a valve which is operated in response to the engine operation and the use of the heater.

According to the present invention, there is provided a system for controlling cooling water temperature for a water-cooled engine having an intake passage, a radiator, a cooling water passage communicating a water jacket in the engine with the radiator, and a thermostat provided in the cooling water passage, the thermostat being so arranged as to open the passage when the cooling water temperature exceeds a predetermined value, the system comprises a bypass for bypassing the thermostat; a bypass valve provided in the bypass for closing the bypass; solenoid operated valve means for actuating the bypass valve; and switch circuit connected parallel to the solenoid operated valve; the switch circuit means comprising a low temperature switch responsive to low cooling water temperature to effect the operation of the solenoid operated valve for closing the bypass valve of the bypass, a high temperature switch responsive to high cooling water temperature to effect the operation of the solenoid operated valve for closing the bypass valve, and a light load switch responsive to the light load operation of the engine to effect the operation of the solenoid operated valve for closing the bypass valve.

The other objects and features are explained more in detail with reference to the accompanying drawings.

DETAILED DESCRIPTION OF THE PREFERRED EMBODIMENTS

Figure 1:
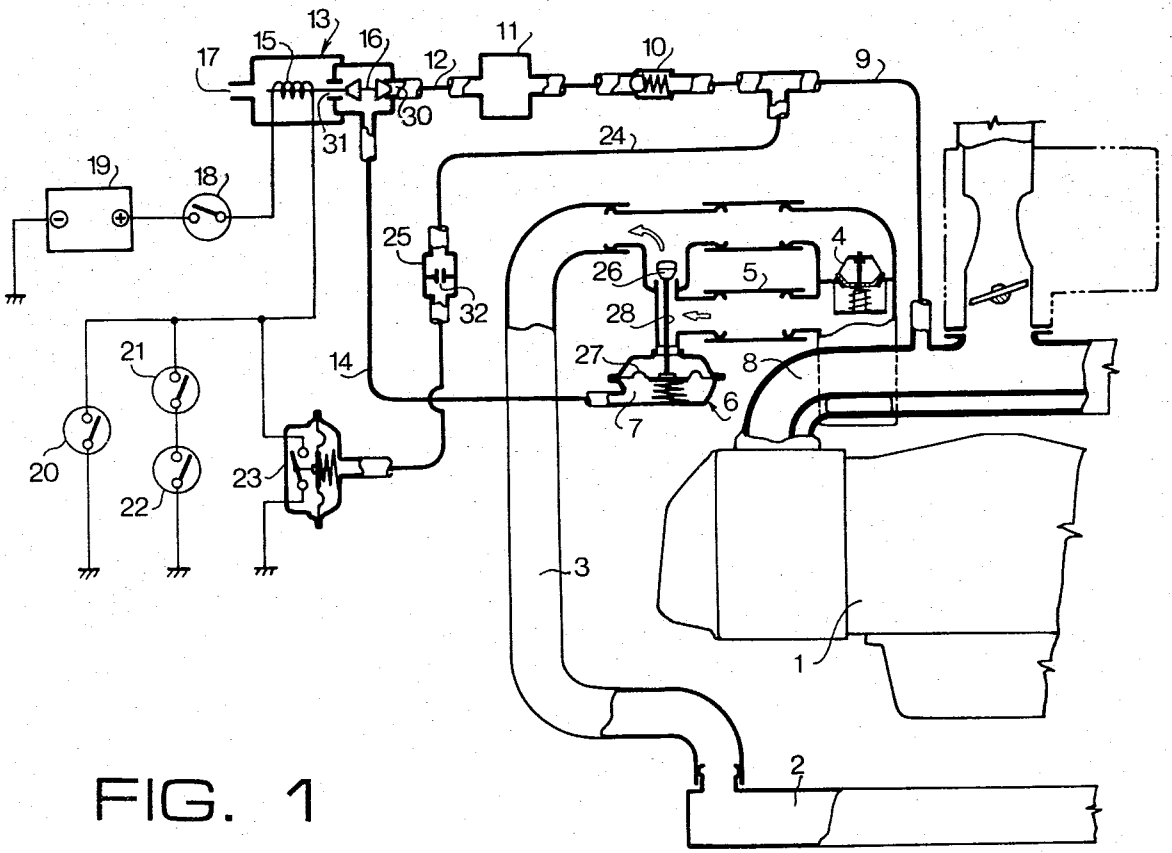
FIG. 1 shows schematically a system for controlling cooling water according to the present invention; and FIGS. *2a* and *2b* are graphs showing operating ranges of a bypass.

Referring to FIG. 1, an engine 1 has a cooling water system comprising a radiator 2, a cooling water passage

3 communicating a water jacket in the engine 1 with the radiator 2. In the cooling water passage 3, a thermostat 4 is provided. The thermostat 4 is a wax pellet type valve and is adapted to open when the temperature of the cooling water exceeds a predetermined value for allowing the cooling water to flow to the radiator 2. In accordance with the present invention, a bypass 5 is provided to bypass the thermostat 4. A diaphragm valve 6 actuated by the vacuum in an intake manifold is provided in the bypass 5. The valve 6 comprises a valve body 26, a vacuum chamber 7 defined by a diaphragm 27, and a rod 28 connecting the valve body 26 with the diaphragm 27. The valve 6 is adapted to close the bypass, when the diaphragm 27 is deflected by vacuum applied in the vacuum chamber 7.

The vacuum chamber 7 is communicated with a vacuum accumulator 11 through a first conduit pipe 14, a solenoid operated valve 13 and a second conduit pipe 12. The vacuum accumulator 11 is communicated with an intake manifold 8 through a check valve 10 and a conduit pipe 9. The valve 13 comprises a solenoid 15, a vacuum port 30, an atmosphere port 31, a valve body 16 connected to a plunger of the solenoid for closing one of the ports 30 and 31, and an atmosphere opening 17. One end of the solenoid 15 is connected to a battery 19 via an engine ignition switch 18, and the other end is connected to the ground through switch circuit which comprises a low temperature switch 20, a heater switch 21, a high temperature switch 22, and a vacuum switch 23.

The low and high temperature switches 20 and 22 detect the cooling water temperature. The low temperature switch 20 is adapted to open when the cooling water temperature is higher than a predetermined low temperature, for example 60° C., for heavy load operation of the engine. The high temperature switch is so arranged to open when the cooling water temperature is higher than a predetermined high temperature, for example 85° C., for the heater. The vacuum switch 23 is operated by the vacuum in the intake manifold 8. To this end, the switch 23 has a vacuum chamber (not shown) and a diaphragm (not shown) deflected by the vacuum for operating the switch. The vacuum chamber is communicated to the conduit pipe 9 through a conduit pipe 24 and a damper valve 25. The damper valve 25 comprises an orifice 32 and serves to absorb the fluctuation of the vacuum in the intake manifold which is caused by the variation of load on the engine. The damper valve 25 is so arranged that when heavy load operation continues for a while, a low vacuum in the intake manifold effects on the vacuum switch 23 to turn off. The thermostat 4 is so designed as to open at a considerable high temperature, for example 110° C., for the purpose of an increase of thermal efficiency and an improvement of fuel consumption.

Figure 2A:
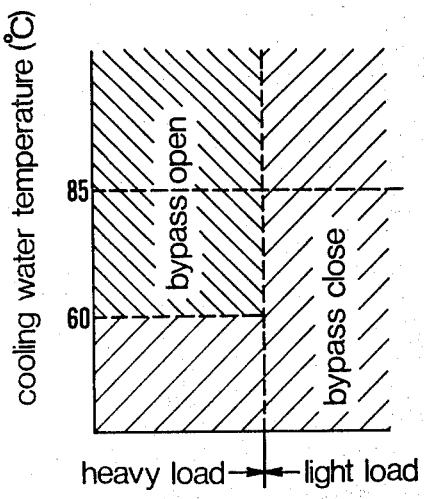

In light load operation, the vacuum switch 23 is closed by the vacuum applied from the intake passage 8 through the damper valve 25. The solenoid 15 is excited to open the vacuum port 30. Accordingly, the vacuum in the accumulator 11 is fed to the vacuum chamber 7 of the valve 6 through the pipes 12 and 14, so that the valve body 26 closes the port of the bypass 5. Therefore, the cooling water flow to the radiator is controlled by the thermostat 4, and hence the temperature of the cooling water is adjusted below the set high temperature 110° C. When the engine operates at a heavy load with a wide throttle opening, the vacuum in the manifold 8 decreases to turn off the vacuum switch 23. However, if the cooling water temperature is lower than the set temperature of the low temperature switch 20, the switch 20 is closed. Therefore, the solenoid 15 remains energized and the bypass 5 is closed by the valve 6. When the cooling water temperature exceeds the set temperature, the switch 20 is opened to de-energize the solenoid 15. Thus, the atmosphere port 31 is opened, so that the atmosphere is applied to the vacuum chamber 7 of the valve 6 to open the bypass. Accordingly, the cooling water passes through the bypass to the radiator 2 without control of temperature by the thermostat in order to increase the cooling effect for the cooling water. FIG. 2*a* shows operating ranges of the bypass.

Figure 2B:
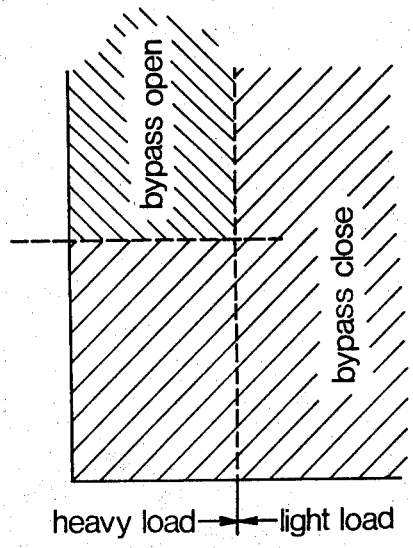

When the heater switch 21 is closed for heating the room of the vehicle, the solenoid 15 is energized as long as the high temperature switch 22 is closed. Therefore, the vacuum is applied to the vacuum chamber 7 to close the bypass. Thus, it is possible to prevent a decrease of heating efficiency owing to decrease of cooling water temperature. If the cooling water temperature exceeds the set value, the switch 22 is turned off to de-energize the solenoid 15 to open the bypass. FIG. 2*b* shows operating ranges of the bypass in heating operation.

From the foregoing it will be understood that the present invention provides a system by which the temperature of the cooling water is controlled to a proper value according to the engine operation and to the operation of the heater, whereby fuel consumption may be improved and engine performance may be increased. Further, since only one thermostat is provided in the cooling water passage, the system can be made in a small space.

While the presently preferred embodiment of the present invention has been shown and described, it is to be understood that this disclosure is for the purpose of illustration and that various changes and modifications may be made without departing from the spirit and scope of the invention as set forth in the appended claim.

What is claimed is:

1. A system for controlling cooling water temperature for a water-cooled engine having an intake passage, a radiator, a cooling water passage communicating a water jacket in said engine with said radiator, and a thermostat provided in said cooling water passage, said thermostat being so arranged as to open said passage when the cooling water temperature exceeds a predetermined value, said system comprising a bypass for bypassing said thermostat;

bypass valve means provided in said bypass for closing the bypass;

solenoid valve means for actuating said bypass valve; and switch circuit means connected parallel to said solenoid valve means for selectively switching the solenoid valve means;

said switch circuit means comprising a low temperature switch responsive to low cooling water temperature to effect the operation of said solenoid valve for closing said bypass valve of said bypass, a high temperature switch means responsive to high cooling water temperature to effect the operation of said solenoid valve for closing said bypass valve, and a light load switch means responsive to the light load operation of the engine to effect the operation of said solenoid valve for closing the bypass valve.

2. The system for controlling cooling water temperature for a water-cooled engine according to claim 1 further comprising a heater switch connected to said high temperature switch in series.

3. The system for controlling cooling water temperature for a water-cooled engine according to claim 1 wherein said bypass valve provided in said bypass is a vacuum operated valve and said light load switch is a vacuum switch.

4. The system for controlling cooling water temperature for a water-cooled engine according to claim 3 further comprising conduit pipe means for applying the vacuum in said intake passage to said vacuum operated valve and to said vacuum switch.

* * * * *